US010490111B2

(12) United States Patent
Mosier et al.

(10) Patent No.: US 10,490,111 B2
(45) Date of Patent: Nov. 26, 2019

(54) PASSIVE AND NONINTRUSIVE MONITORING AND REPORTING OF FROZEN LIQUID CRYSTAL DISPLAY (LCD)

(71) Applicant: Rockwell Collins, Inc., Cedar Rapids, IA (US)

(72) Inventors: Donald E. Mosier, Cedar Rapids, IA (US); Craig E. Harwood, Cedar Rapids, IA (US)

(73) Assignee: Rockwell Collins, Inc., Cedar Rapids, IA (US)

( * ) Notice: Subject to any disclaimer, the term of this patent is extended or adjusted under 35 U.S.C. 154(b) by 14 days.

(21) Appl. No.: 15/835,141

(22) Filed: Dec. 7, 2017

(65) Prior Publication Data

US 2019/0180660 A1 Jun. 13, 2019

(51) Int. Cl.

| | |
|---|---|
| ***G09G 5/00*** | (2006.01) |
| ***G09G 3/00*** | (2006.01) |
| ***G09G 5/36*** | (2006.01) |
| ***G09G 3/36*** | (2006.01) |
| *G09G 3/3225* | (2016.01) |
| *G09G 3/32* | (2016.01) |
| *G09G 5/02* | (2006.01) |

(52) U.S. Cl.

CPC ..... *G09G 3/006* (2013.01); *G09G 3/3618* (2013.01); *G09G 5/363* (2013.01); *G09G 3/32* (2013.01); *G09G 3/3225* (2013.01); *G09G 3/3614* (2013.01); *G09G 3/3648* (2013.01); *G09G 5/024* (2013.01); *G09G 2320/0257* (2013.01); *G09G 2330/12* (2013.01); *G09G 2380/12* (2013.01)

(58) Field of Classification Search

CPC ..... G09G 3/006; G09G 2300/0452; G09G 2310/0256; G09G 2310/0262; G09G 2320/0233; G09G 2320/0613; G09G 2320/0693; G09G 2330/10; G09G 3/2051; G09G 3/36; G09G 5/005

See application file for complete search history.

(56) References Cited

U.S. PATENT DOCUMENTS

| | | | | |
|---|---|---|---|---|
| 2007/0030284 | A1* | 2/2007 | Ogasawara | G09G 3/2003 345/589 |
| 2013/0249933 | A1* | 9/2013 | Yoshida | G06K 19/06037 345/590 |
| 2014/0184670 | A1* | 7/2014 | Jeong | G09G 3/2003 345/694 |
| 2016/0189656 | A1* | 6/2016 | Park | G09G 3/006 345/694 |

* cited by examiner

*Primary Examiner* — Hau H Nguyen
(74) *Attorney, Agent, or Firm* — Suiter Swantz pc llo

(57) ABSTRACT

A passively and nonintrusively monitoring liquid crystal display (LCD) system includes a graphics controller configured to generate alternating sets of drive instructions and forward the drive instructions for execution by drive electronics to activate display elements of a display surface. An initial set of drive instructions corresponding to a first frame causes the drive electronics to draw an initial pattern such as a solid red fill to selected regions of the display surface. An alternating set of drive instructions causes the drive electronics to draw a contrasting pattern such as a solid cyan fill to the selected regions. Given a sufficiently high refresh rate between the initial and alternating sets, a human operator perceives only the integration of the two patterns unless the display system is in a stuck or frozen state, when the frozen initial and contrasting patterns clearly and quickly indicate the stuck/frozen failure condition.

16 Claims, 10 Drawing Sheets

PASSIVE AND NONINTRUSIVE MONITORING AND REPORTING OF FROZEN LIQUID CRYSTAL DISPLAY (LCD)

BACKGROUND

The largest hurdle in safe operation of a flight display is to ensure the extreme improbability of displaying "false or misleading information" to the pilot. False or misleading information may include information that may be accurate or correct as of a time $t_0$, but no longer accurate or correct as of some subsequent time $t_1$ (due to, for example, continuous changes in the perspective and position of an aircraft as it proceeds through space). This particular type of false or misleading information may result from a "stuck" or "frozen" display. Worse yet, the pilot may not know that a stuck or frozen display is providing false or misleading information, instinctually relying on the display contents as though they reflected reality although this may no longer be the case.

For example, an active-matrix liquid-crystal display (AM-LCD) may hold information on a screen or display surface. Images are "drawn" to the display surface by charging capacitors to a drive voltage proportional to the brightness of each individual display element (e.g., pixel, subpixel). These capacitors may include: (1) the electrodes used to directly control the state of an LCD subpixel; (2) component parts of the drive circuitry for controlling the current drive of an organic light emitting diode (OLED) sub-pixel; or (3) component parts of the drive circuitry for other matrix-driven display types. The display surface may correspond to a two-dimensional M×N array of such capacitors (e.g., M rows of N capacitors each), enabled one row at a time starting with the topmost row. When a row of capacitors is charged to the appropriate drive voltages, the row may be isolated by deactivating its controlling transistors and activating the transistors corresponding to the next row, thereby charging the next row of capacitors. In this way, each individual row may be refreshed until the entire display surface has been freshly drawn to, at which point the process is repeated starting with the topmost row. The display surface may thus be refreshed may times per second (e.g., at a predetermined "refresh rate" such as 60 Hz) such that the human eye perceives the display contents as continually dynamic (provided the refresh rate is faster than the human flicker frequency threshold).

If the controlling circuitry becomes disabled, the capacitor charging process may stop, "freezing" each row of capacitors in their last charged state and the display as a whole in its last commanded condition. It may be possible to monitor the display system in order to detect failed circuitry, but sensor-based monitoring is at once expensive, bulky, and cumbersome. Consequently, while such monitoring may be found in some types of customized display systems, it is rare in cost-effective commercial off the shelf (COTS) displays. Furthermore, even a sophisticated sensor-based monitoring system may cover only a limited portion of a display surface, or a limited number of possible failure types. Absent any sort of active monitor for detecting failed drive circuitry, a last commanded image will remain onscreen. However, the pilot may not perceive the display as stuck or frozen until capacitor voltages deteriorate or leak to a significant enough degree to degrade image quality and render the stuck condition obvious to the naked eye. Prior generations of AM-LCD displays, for example, may be associated with higher voltages required to drive a normally white display to black levels. As degraded black performance more rapidly affects the uniformity and contrast ratio of a display, it is highly visible—rendering a frozen LCD obviously invalid within a few seconds.

However, advances in AM-LCD technology may complicate, rather than alleviate, this problem. Contemporary AM-LCD systems tend to use a normally black approach rather than a normally white approach. Similarly, such AM-LCD systems may have better and less leaky transistors, and use purer liquid crystal fluids less subject to capacitor leakage. As a result, the black backgrounds of frozen displays may linger far longer while only bright portions degrade due to leakage. Further, as this leakage is far slower, a frozen AM-LCD may appear unaffected for a minute or two before any degradation is perceived—which may lead to extremely unsafe flight conditions if the pilot instinctually relies on such outdated visual intelligence without cause to question it.

SUMMARY

In one aspect, embodiments of the inventive concepts disclosed herein are directed to a passively and nonintrusively monitoring display system. The display system includes a display surface incorporating a two-dimensional M×N array of pixels, subpixels, or other display elements, and drive electronics configured to continuously draw a sequence of frames to the display surface by activating the display elements (e.g., on a row by row basis) based on drive instructions. The display system includes a graphics controller (e.g., graphics generator) configured to generate the drive instructions and forward the drive instructions for the drive electronics. For example, the graphics controller may generate an initial set of drive instructions corresponding to a first frame of the frame sequence; the initial set causes the drive electronics to activate the display elements to draw an initial pattern within a first region or set of regions of the display surface (each region corresponding to a first set of display elements) and a contrasting pattern (contrasting to the initial pattern) to a second region or set of regions (corresponding to a second set of display elements). The graphics controller may generate an alternating set of drive instructions corresponding to a second frame of the frame sequence (the frame sequence being achieved by continually refreshing the first frame with the second frame and vice versa). The alternating set causes the drive electronics to activate the display elements to draw the contrasting pattern to the first region or set of regions and the initial pattern to the second region or set of regions. The human operator will not perceive either the initial pattern or the contrasting pattern unless the display system is in a stuck or frozen state, wherein the initial pattern and contrasting pattern will indicate the failure condition.

In a further aspect, embodiments of the inventive concepts disclosed herein are directed to a passively and nonintrusively monitoring display system configured to guard against afterimage by offsetting the frame sequences from the polarity of drive voltages. The display system includes a display surface incorporating a two-dimensional M×N array of pixels, subpixels, or other display elements, and drive electronics configured to continuously draw a sequence of frames to the display surface by activating the display elements (e.g., on a row by row basis) based on drive instructions. The display system includes a graphics controller (e.g., graphics generator) configured to generate the drive instructions and forward the drive instructions for the drive electronics. The graphics controller may generate a primary set of drive instructions corresponding to a first frame, e.g., wherein the frame sequence is a continually repeating three-frame sequence. The primary set causes the drive electronics to activate the display elements to draw: a first pattern within a first region or set of regions of the display surface (corresponding to a first set of display elements); a second pattern (contrasting with the first pattern) within a second region or region set; and a third pattern within a third region or region set. The graphics controller may generate a secondary set of drive instructions corresponding to the second frame of the repeating three-frame sequence, the secondary set causing the drive electronics to draw the first pattern within the third region or region set, the second contrasting pattern to the first region or region set, and the third pattern to the second region or region set. The graphics controller may generate a tertiary set of drive instructions corresponding to the third frame of the three-frame sequence, the tertiary set causing the drive electronics to draw the first pattern to the second region or region set, the second contrasting pattern to the third region or region set, and the third pattern to the first region or region set. The human operator will not perceive either the initial pattern or the contrasting pattern unless the display system is in a stuck or frozen state, wherein the initial pattern and contrasting pattern will indicate the failure condition.

BRIEF DESCRIPTION OF THE DRAWINGS

Implementations of the inventive concepts disclosed herein may be better understood when consideration is given to the following detailed description thereof. Such description makes reference to the included drawings, which are not necessarily to scale, and in which some features may be exaggerated and some features may be omitted or may be represented schematically in the interest of clarity. Like reference numerals in the drawings may represent and refer to the same or similar element, feature, or function. In the drawings.

DETAILED DESCRIPTION OF EXEMPLARY EMBODIMENTS

Figure 1:
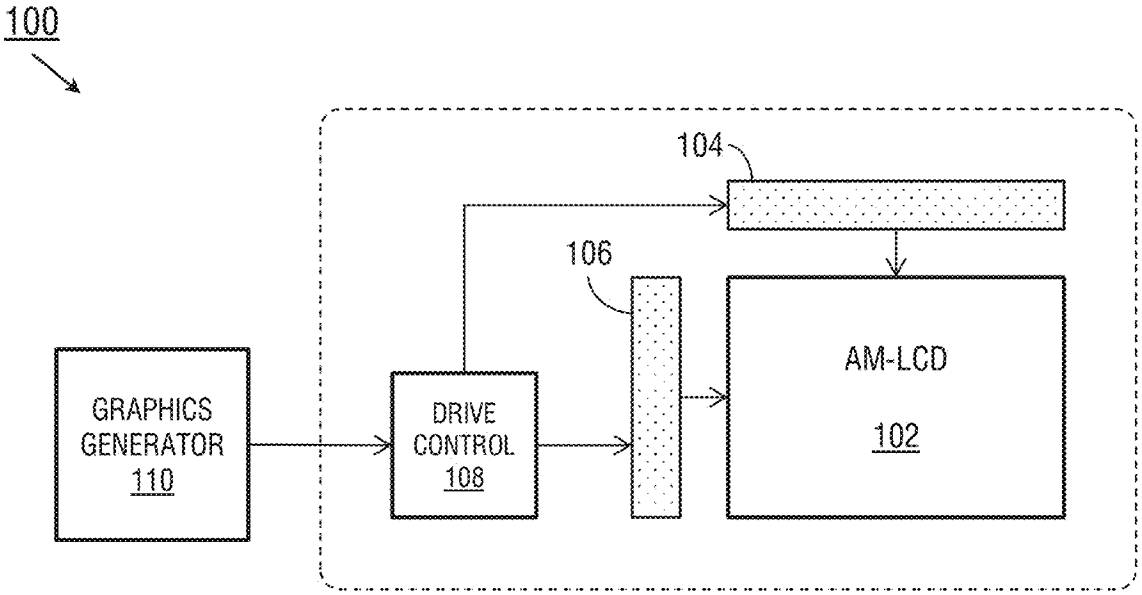
FIG. 1 is a diagrammatic illustration of an exemplary embodiment of a passively and nonintrusively monitoring display system according to the inventive concepts disclosed herein.

Before explaining at least one embodiment of the inventive concepts disclosed herein in detail, it is to be understood that the inventive concepts are not limited in their application to the details of construction and the arrangement of the components or steps or methodologies set forth in the following description or illustrated in the drawings. In the following detailed description of embodiments of the instant inventive concepts, numerous specific details are set forth in order to provide a more thorough understanding of the inventive concepts. However, it will be apparent to one of ordinary skill in the art having the benefit of the instant disclosure that the inventive concepts disclosed herein may be practiced without these specific details. In other instances, well-known features may not be described in detail to avoid unnecessarily complicating the instant disclosure. The inventive concepts disclosed herein are capable of other embodiments or of being practiced or carried out in various ways. Also, it is to be understood that the phraseology and terminology employed herein is for the purpose of description and should not be regarded as limiting.

As used herein a letter following a reference numeral is intended to reference an embodiment of the feature or element that may be similar, but not necessarily identical, to a previously described element or feature bearing the same reference numeral (e.g., 1, 1a, 1b). Such shorthand notations are used for purposes of convenience only, and should not be construed to limit the inventive concepts disclosed herein in any way unless expressly stated to the contrary.

Further, unless expressly stated to the contrary, "or" refers to an inclusive or and not to an exclusive or. For example, a condition A or B is satisfied by anyone of the following: A is true (or present) and B is false (or not present), A is false (or not present) and B is true (or present), and both A and B are true (or present).

In addition, use of the "a" or "an" are employed to describe elements and components of embodiments of the instant inventive concepts. This is done merely for convenience and to give a general sense of the inventive concepts, and "a" and "an" are intended to include one or at least one and the singular also includes the plural unless it is obvious that it is meant otherwise.

Finally, as used herein any reference to "one embodiment," or "some embodiments" means that a particular element, feature, structure, or characteristic described in connection with the embodiment is included in at least one embodiment of the inventive concepts disclosed herein. The appearances of the phrase "in some embodiments" in various places in the specification are not necessarily all referring to the same embodiment, and embodiments of the inventive concepts disclosed may include one or more of the features expressly described or inherently present herein, or any combination of sub-combination of two or more such features, along with any other features which may not necessarily be expressly described or inherently present in the instant disclosure.

Broadly, embodiments of the inventive concepts disclosed herein are directed to a system and related methods for providing passive and nonintrusive monitoring of either a commercial off the shelf (COTS) avionics display system or a custom avionics display without dedicated hardware monitoring. The graphics generator inserts alternating high contrast patterns into the sequence of frames drawn by the drive controller, such that when the display system sticks or freezes an indicator of the failure condition is immediately and prominently visible to the pilot.

Referring to FIG. 1, an exemplary embodiment of a passively and nonintrusively monitoring display system 100 display system 100 may be embodied in an avionics display (e.g., a primary flight display (PFD)) aboard an aircraft) and may incorporate a commercial off-the-shelf (COTS) display unit (102), drive electronics (e.g., external driver chips 104, 106 and a drive controller 108) and a graphics generator 110. For example, the display unit 102 may be an active-matrix liquid crystal display (AM-LCD) with a two-dimensional display surface corresponding to an array (e.g., a two-dimensional M×N array) of display elements (e.g., pixels, sub-pixels, liquid crystal display elements, light-emitting diodes (LED), micro-LEDs, organic LEDs (OLED)). As described above, each individual display element may include a capacitor charged to the appropriate drive voltage and held there by a switching transistor; the M×N array may be an array of M rows of N display elements each, wherein each row of display elements is charged to the desired drive voltage (based on, e.g., brightness or color values) and held until the next frame is drawn (e.g., the next refresh cycle). Based on the desired refresh rate (e.g., 60 Hz, 120 Hz, or any appropriate refresh rate in excess of an applicable human flicker frequency threshold), the display system 100 may draw a completely new frame to the display unit 102 a predetermined number of times per second (e.g., 60 frames per second).

The graphics generator 110 may include hardware and software for generating specific drive instructions implemented by the drive controller 108 via the external driver chips 104, 106. For example, gate drivers (106) may digitally and sequentially enable the M×N array of display elements on a row by row basis, while source drivers (104) may provide analog drive voltages to the individual capacitors corresponding to the row of display elements currently enabled by the gate drivers 106. The drive instructions may provide for drawing specific frames corresponding to required images, based on sensor input as well as the position, velocity, and heading of the embodying aircraft. For example, a sequence of continually refreshing frames may correspond to a sequence of discrete sets of drive instructions, each set corresponding to a new frame (e.g., an odd-numbered or even-numbered frame).

Figure 2A:
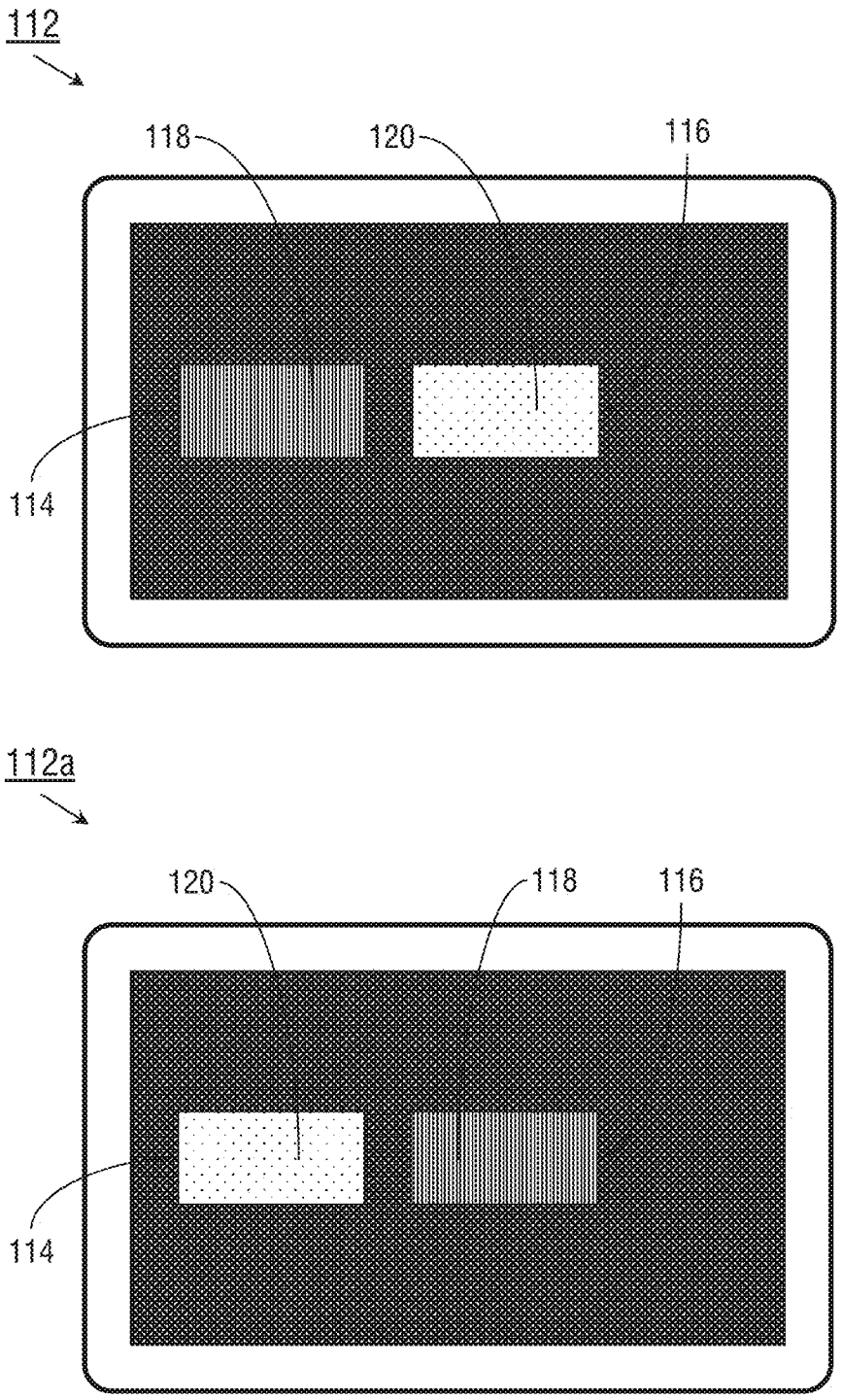
FIG. 2A illustrates the system of FIG. 1.

Referring to FIG. 2A, a display surface 112 may be drawn by the display system 100 of FIG. 1. For example, the display system 100 may implement passive monitoring by, every other frame, drawing in one or more otherwise unused regions 114, 116 of the display surface 112 an initial pattern 118 and a contrasting pattern 120 respectively. For example, during every odd-numbered frame of a 60 Hz refresh cycle (e.g., frame 1, 3, . . . 59) the display system 100 may draw the initial pattern 118 and the contrasting pattern 120 to respective regions of the display surface 102.

The display surface 112*a* may be implemented similarly to the display surface 112 except that, during every even-numbered frame (e.g., frames 2, 4, . . . 60) of the refresh cycle, the display system 100 may reverse the drawn patterns, drawing the initial pattern 118 to the region 114 and the contrasting pattern 120 to the region 116. Any appropriately contrasting combination of patterns may be employed by the display system 100. For example, the initial pattern 118 may be drawn as a solid red fill while the contrasting pattern 120 may be drawn as a solid cyan (blue+green) fill.

Figure 2B:
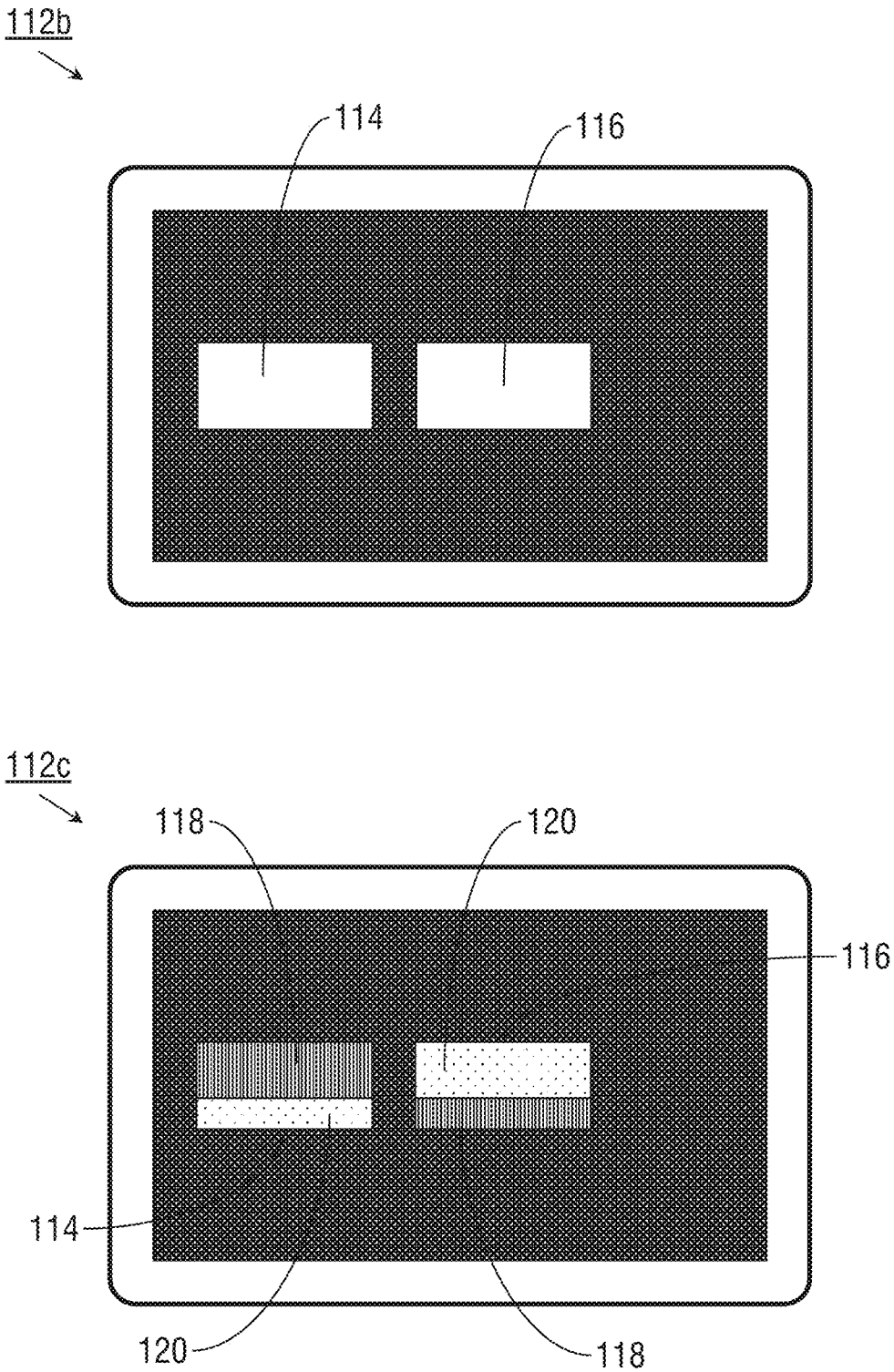
FIG. 2B illustrates the system of FIG. 2A in a normal and a "stuck" condition.

Referring now to FIG. 2B, the display surface 112*b* may be implemented and may function similarly to the display surfaces 112, 112*a* of FIG. 2A except that the result of the sequential application by the display system 100 (FIG. 1) of the initial patterns (118, FIG. 2A) and the contrasting patterns (120, FIG. 2A) at a rate exceeding the human flicker frequency threshold is to create, within both regions 114 and 116, the appearance to human eyes of a white or grey region (e.g., of reduced luminance compared to a solid white fill). This is the result of temporal integration by the viewer (e.g., the human eye) of individual primary colors (e.g., red, green, blue (RGB)) into the perceived white or grey region. Modern electronic display systems operate by integrating primary or secondary colors into additional perceived colors, but the integration process may be accomplished in several different ways. Primary colors may be spatially integrated by displaying pixels or sub-pixels of sufficiently small size as to be below the human detection threshold; for example, by interleaving sufficiently small individual green and blue display elements, the human operator will perceive cyan. Temporal integration achieves the same perceived colors by alternatively displaying fields of contrasting colors at a rate or frequency (e.g., frame rate, refresh rate) in excess of the human flicker frequency threshold. The human flicker frequency threshold may vary from person to person (e.g., depending on age) and based on a variety of other parameters (e.g., the precise area of the retina stimulated, the fatigue level of the observer, the wavelength and luminous intensity of the light source, or the observer's sensitivity and adaptation to light and dark, e.g., exposure to background light).

Accordingly, by alternating the initial pattern 118 and the contrasting pattern 120 (as shown by FIG. 2A) at a sufficiently high rate, the human operator perceives neither the red/cyan patterns of the display surface 112 nor the cyan/red patterns of the display surface 112*a* (nor the flickering effect of the two display surfaces 112, 112*a* alternating with each other at a rate too slow for integration) but a temporal integration of the two patterns, e.g., the solid grey/white patterns of the display surface 112*b* as shown by FIG. 2B. While the display surface 112*b* may be implemented using any appropriate combination of contrasting colors as constituent colors (e.g., blue/yellow (yellow being an integration of green and red) or green/magenta (an integration of red and blue)), red has the added benefit of indicating a danger or alert condition to trained pilots when the display system 100 is in a stuck or "frozen" state, as indicated by the display surface 112*c* below.

The display surface 112*c* may be implemented and may function similarly to the display surface 112*b*, except that the display surface 112*c* may reflect the display system 100 in a stuck or frozen condition. For example, refresh operations of the display system 100 may stop while an even-numbered frame (as shown by the display surface 112*a*, FIG. 2A) is being refreshed by an odd-numbered frame (as shown by the display surface 112, FIG. 2A). When refresh operations stop due to a stuck/frozen condition, so does the temporal integration process: the human operator perceives not the display surface 112*b* (a temporal integration of the display surfaces 112, 112*a* (FIG. 2A)), but instead the display surface 112*c* and the constituent colors of the initial pattern 118 and contrasting pattern 120 (e.g., red and cyan). Throughout both regions 114, 116, the last refreshed pattern is held; for example, the region 114 may show the contrasting pattern 120 being replaced by the initial pattern 118, and the region 116 may show the initial pattern 118 being replaced by the contrasting pattern 120. In either case, both regions 114, 116 may appear not as solid white or grey regions but as solid red and cyan regions or, as shown by the display surface 112*c*, a region 114 partially red (initial pattern 118) and partially cyan (contrasting pattern 120) and a contrasting region 116 partially cyan (contrasting pattern 120) and partially red (initial pattern 118). The pilot may instantly perceive the color changes within the regions 114, 116 (white/grey to red or cyan) as a clear indication of a frozen display. Further, the human operator may perceive, and react to, the solid red portions (118) of the regions 114, 116 as a warning indicator.

Figure 3A:
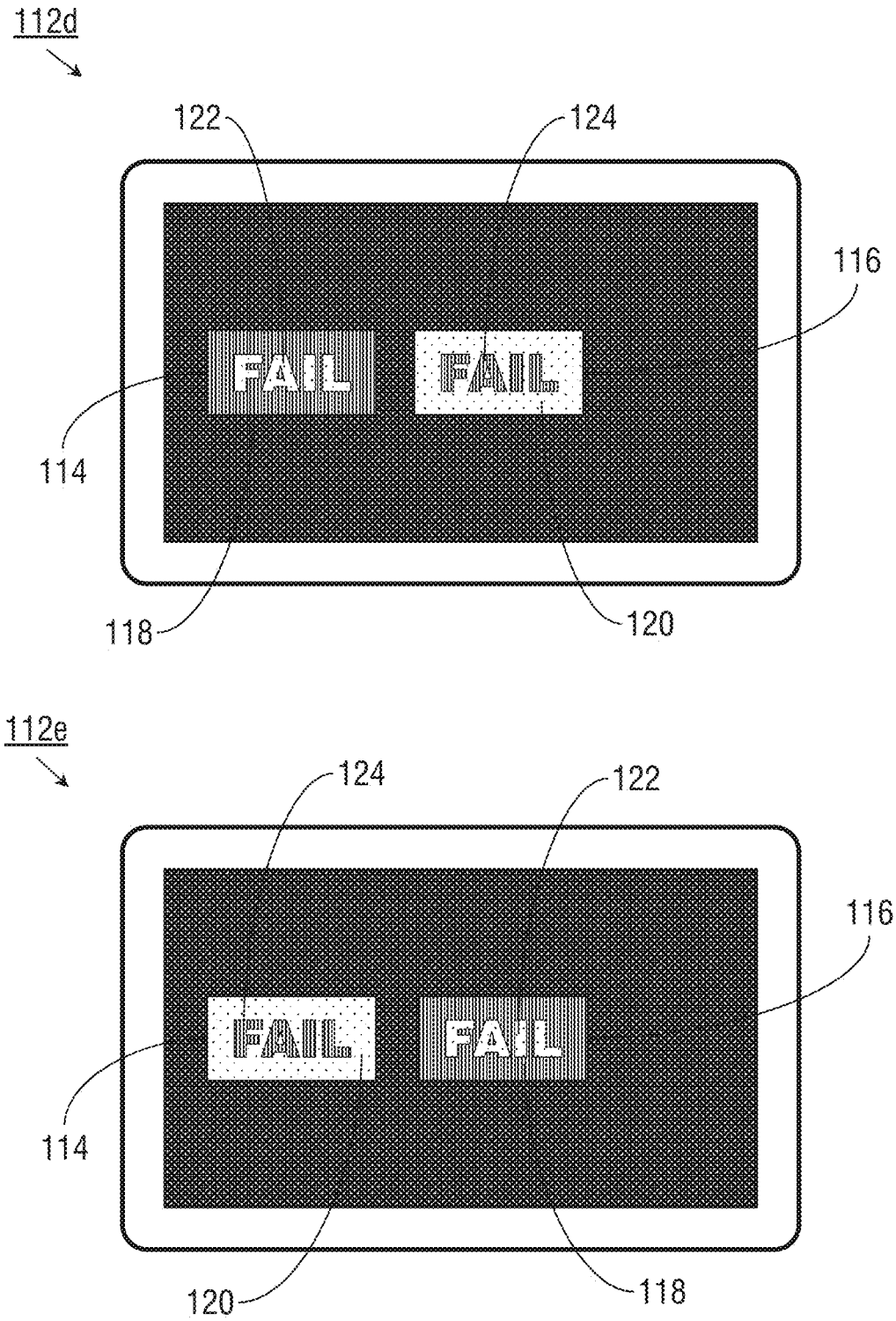
FIG. 3A illustrates the system of FIG. 1.

Referring to FIG. 3A, the display surface 112*d* may be implemented and may function similarly to the display surface 112 of FIG. 2A, except that the display system 100 (FIG. 1) may enhance warning visibility by drawing (e.g., during odd-numbered frames) within the display surface 112*d* (particularly within the regions 114, 116) secondary contrasting indicators 122, 124 within, and contrasting respectively with, the initial pattern 118 and the contrasting pattern 120. For example, if the initial pattern 118 corresponds to a solid red fill and the contrasting pattern 120 corresponds to a solid cyan fill, the display system 100 may draw a cyan indicator (122; e.g., the word "FAIL" or "FROZEN") within the initial pattern 118 and a corresponding red indicator 124 within the contrasting pattern 120. Similarly to the initial pattern 118 and contrasting pattern 120, the secondary contrasting indicators 122, 124 may incorporate any appropriate contrasting component colors (e.g., red/cyan, blue/yellow, green/magenta).

The display surface 112*e* may be implemented and may function similarly to the display surface 112*a* of FIG. 2A, except that the display surface 112*e* may likewise indicate the drawing by the display system 100 (via the drive controller 108) of a secondary contrasting indicator 122 (e.g., a red indicator) within the contrasting pattern 120 (e.g., a solid cyan fill) drawn within the region 114, and a secondary contrasting indicator 124 (e.g., a cyan indicator) within the initial pattern 118 (e.g., a solid red fill) drawn within the region 116.

Figure 3B:
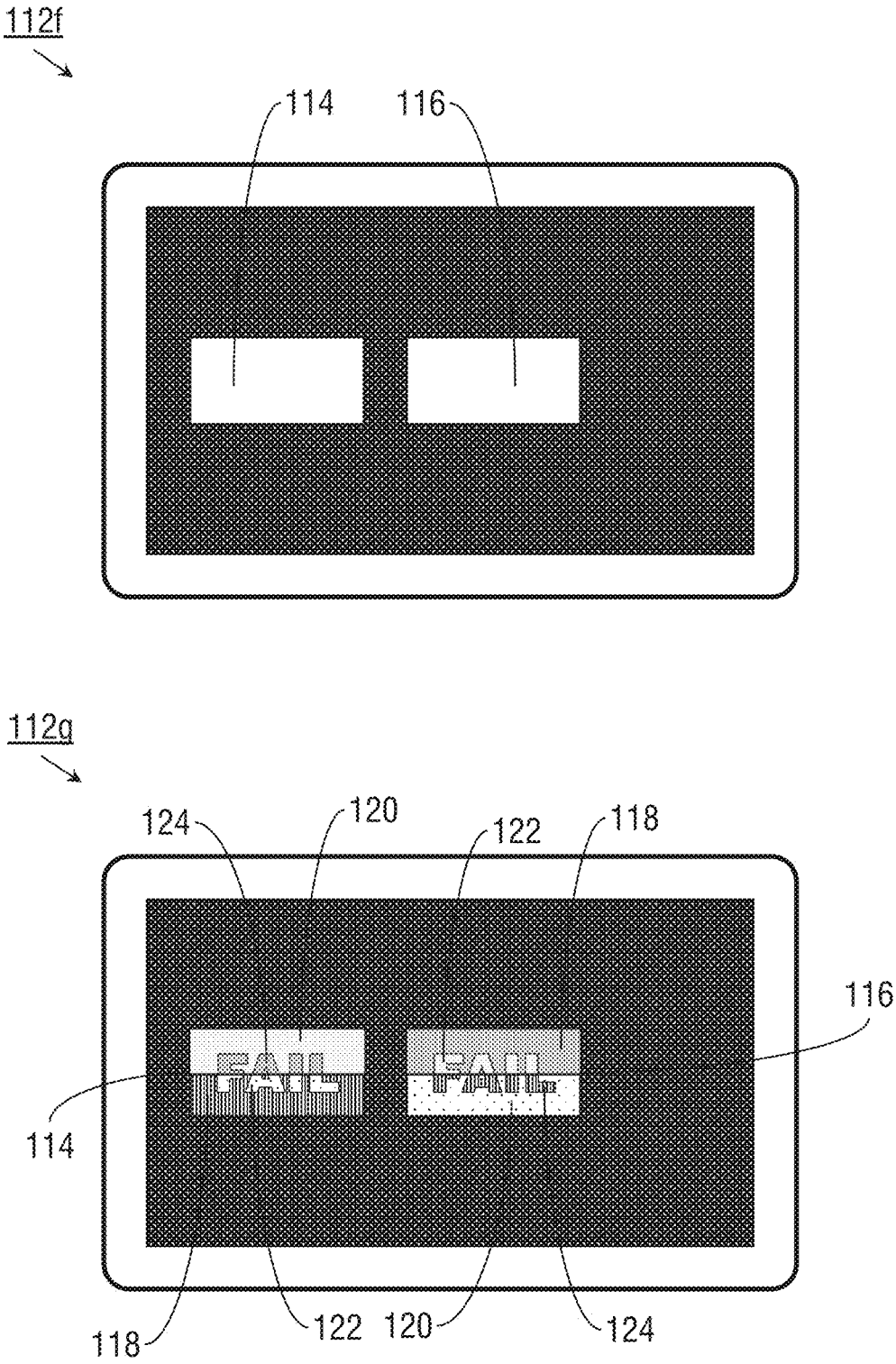
FIG. 3B illustrates the system of FIG. 3A in a normal and a "stuck" condition.

Referring now to FIG. 3B, the display surface 112*f* may be implemented and may function similarly to the display surface 112*b* of FIG. 2B, as the sequential application by the display system 100 of the secondary contrasting indicators 122, 124 (FIG. 3A) within the regions 114, 116 similarly results in the appearance of solid white or grey regions 114, 116 (e.g., solid grey of reduced luminance compared to a solid white fill). The display surface 112*g* may be implemented and may function similarly to the display surface 112*c* of FIG. 2B, except that when the display system 100 is stuck or frozen, the display surface 112*g* may indicate not only the contrast between the solid initial patterns 118 and the contrasting patterns 120, but the contrast between the secondary contrasting indicators 122, 124 drawn therewithin (e.g., red text on a cyan background, or cyan text on a red background).

Figure 3C:
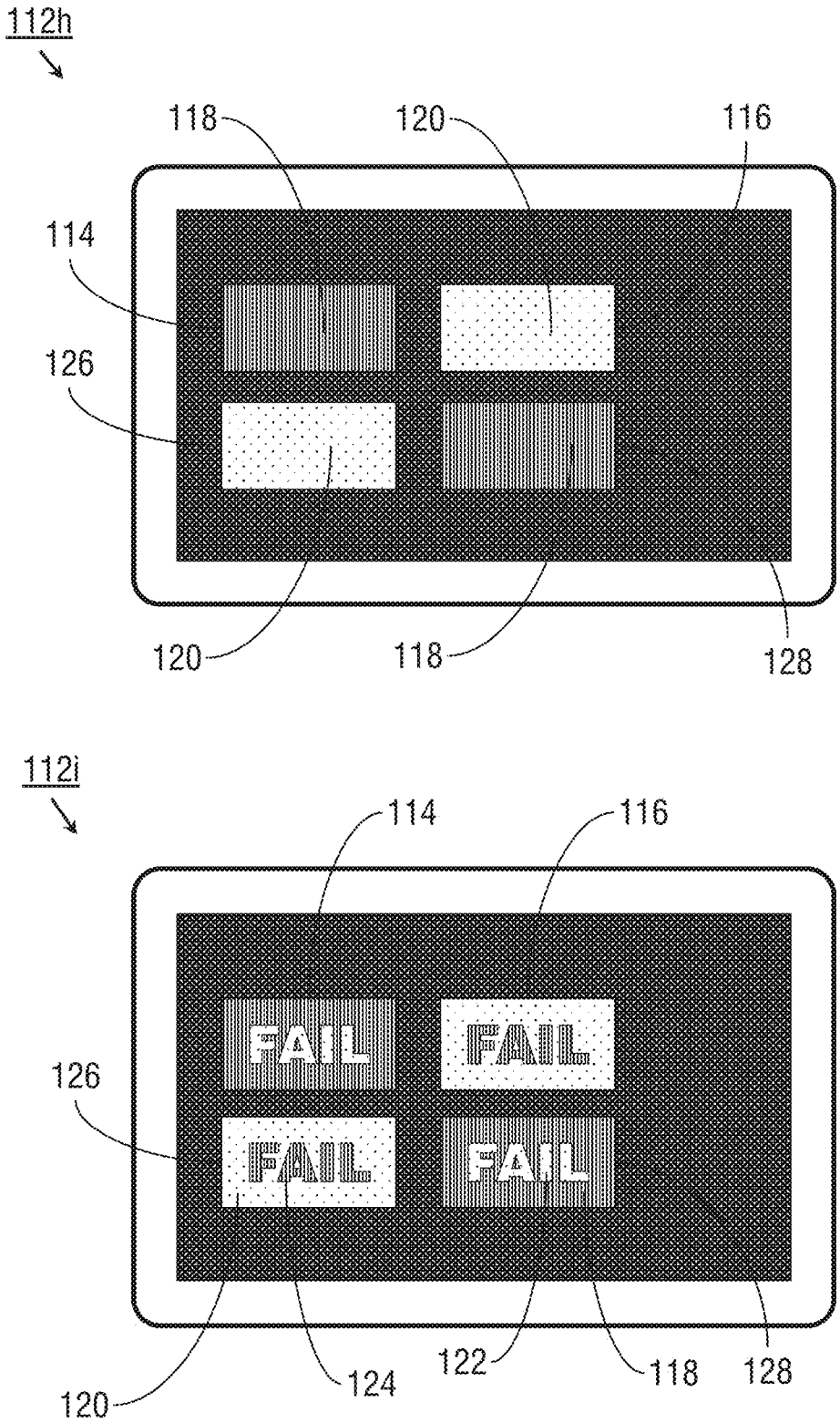
FIG. 3C illustrates the system of FIG. 1.
Figure 3D:
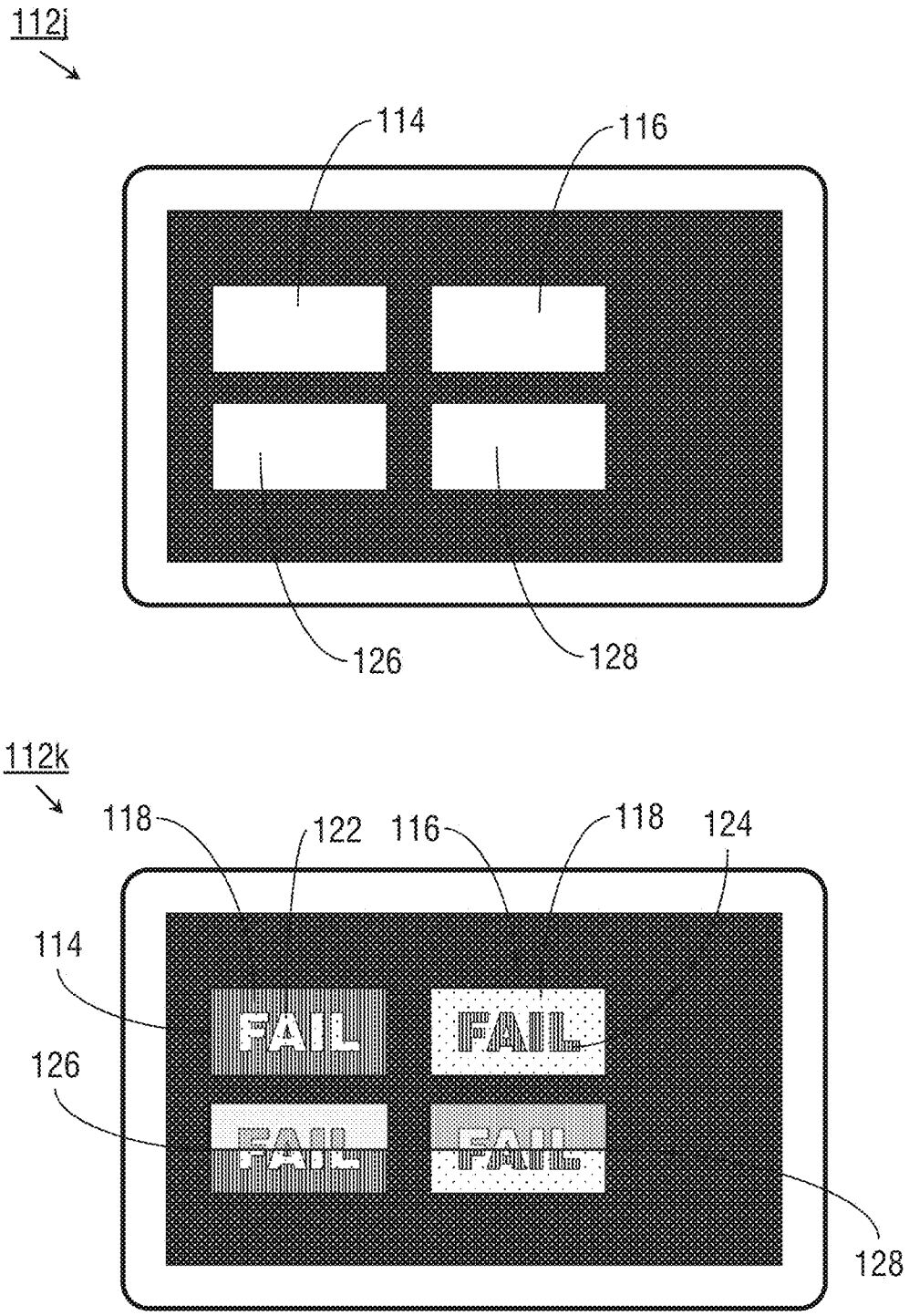
FIG. 3D illustrates the system of FIG. 3C in a normal and a "stuck" condition.

Referring now to FIG. 3C, the display surfaces 112*h*, 112*i* may be implemented and may function similarly to the display surfaces 112, 112*d* of FIGS. 2A and 3A respectively, except that additional regions 126, 128 adjacent to the regions 114, 116 (e.g., vertically, as well as horizontally, adjacent) may be filled by the display system 100 with initial and contrasting patterns 118, 120 and/or secondary contrasting indicators 122, 124. Referring also to FIG. 3D, the display surface 112*j* may be implemented and may function similarly to the display surfaces 112*b*, 112*f* of FIGS. 2B and 3B respectively, as the regions 114, 116, 126, 128 may all appear as solid white or grey regions. The display surface 112*k* may be implemented and may function similarly to the display surfaces 112*c*, 112*g* of FIGS. 2B and 3B respectively, except that the display system 100 may more clearly indicate a stuck or frozen condition by ensuring that at least one set of full regions (e.g., either the top regions 114, 116 or the bottom regions 126, 128) is always represented by either a full solid initial pattern 118 and contrasting pattern 120 (e.g., a solid red region and adjacent solid cyan region) or the full solid initial and contrasting patterns (e.g., within regions 114, 116) and the corresponding secondary contrasting indicators 122, 124.

Figure 4:
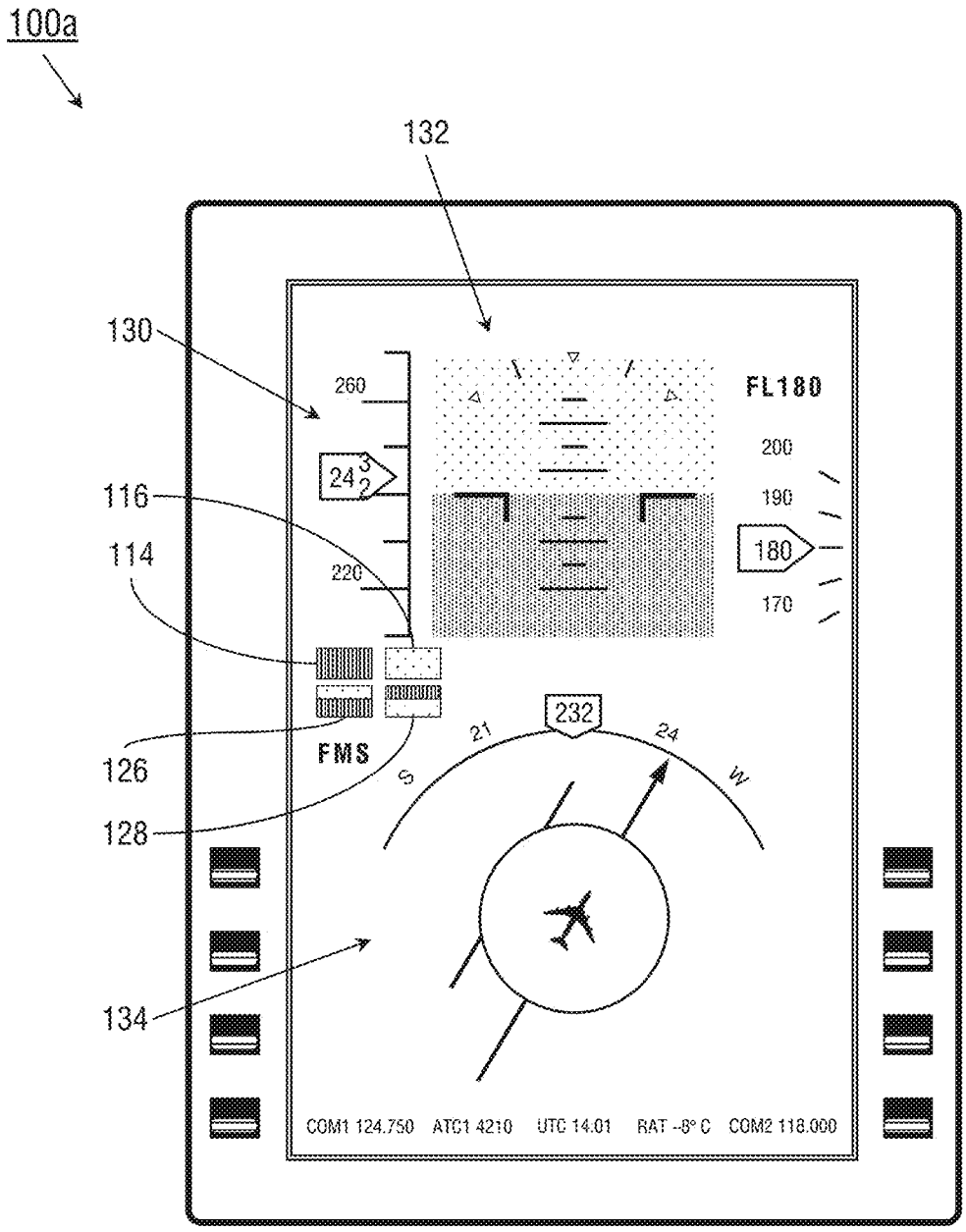
FIG. 4 illustrates an exemplary embodiment of an avionics display system according to the inventive concepts disclosed herein.

Referring to FIG. 4, the avionics display system 100*a* may be implemented and may function similarly to the display system 100 of FIG. 1, except that the avionics display system 100*a* may incorporate the regions 114, 116, 126, 128 (and the corresponding initial pattern 118 and contrasting pattern 120) proximate to a critical area of the display surface 112 of the avionics display system, in order to ensure that a stuck or frozen condition warning may be promptly noticed by the pilot. For example, the avionics display system 100*a* may include a primary flight display (PFD) wherein the regions 114, 116, 126, 128 are positioned proximate to a critical PFD component, e.g., an airspeed indicator 130, an attitude indicator 132, or a heading indicator 134.

The display system 100 may ensure that no direct-current (DC) drive voltage is maintained on any individual LCD display element for an extended period of time. For example, LCD display elements are subject to afterimage (image retention) if residual DC drive voltages are maintained. Because conventional LCD systems may reverse the polarity (e.g., positive/negative) of the drive voltage of each individual display element with every frame, this may result in odd-numbered frames (e.g., the display surface 112, FIG. 2A) always being driven to one polarity while even-numbered frames (e.g., the display surface 112*a*, FIG. 2A) are always driven to the opposite polarity. The display system 100 may instead address this potential problem (e.g., via the drive controller 108, FIG. 1) by reversing the polarity of the drive voltage of each display element after every even-numbered frame is displayed (e.g., the display surface 112*a*) and before the subsequent odd-numbered frame (e.g., the display surface 112) is displayed.

Alternatively, the display system 100 may prevent afterimage by modifying the displayed frame sequence rather than the drive voltage polarities. For example, while displaying a sequence of alternating odd-numbered (e.g., display surfaces 112, 112*d* (FIG. 3A), 112*h* (FIG. 3C) and 112*i* (FIG. 3C)) and even-numbered frames (e.g., display surfaces 112*a* and 112*e* (FIG. 3A)), after every N frames (e.g., after every (N/2) sequences of odd-numbered and even-numbered frames) the display system 100 may repeat an odd-numbered or even-numbered frame. For example, the graphics generator 110 may repeat a set of drive instructions, such that an odd-numbered frame is drawn twice before the display sequence continues with an even-numbered frame (or an even-numbered frame is displayed twice before the sequence continues with an odd-numbered frame). Consequently, for any given region (114, FIG. 2A) of a display surface 112, both an initial pattern 118 (e.g., a red fill) and a contrasting pattern 120 (e.g., a cyan fill) may be drawn during both drive voltage polarities.

Figure 5A:
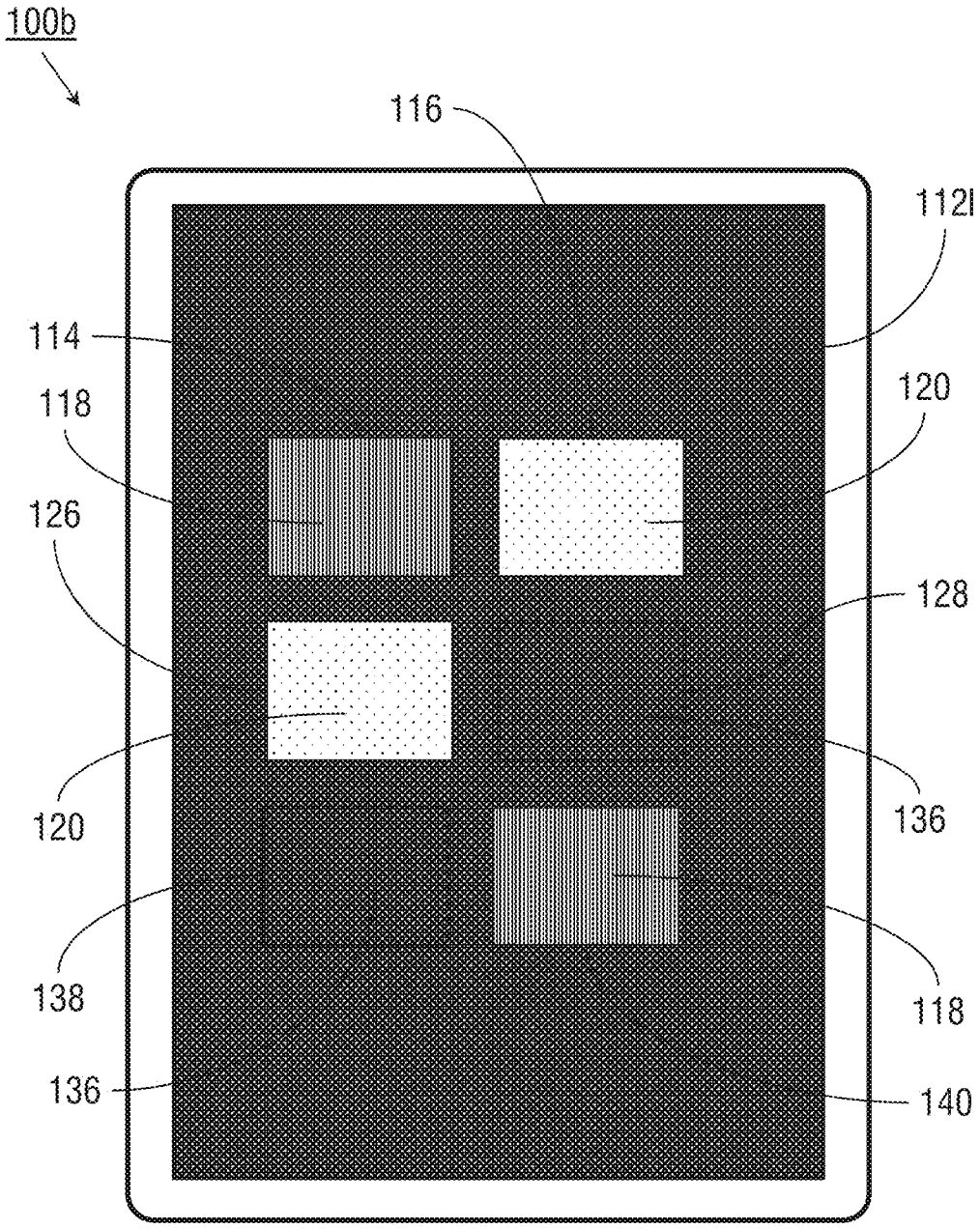
FIGS. 5A and 5B illustrate the system of FIG. 1.

Referring now to FIG. 5A, the display system 100*b* may be implemented and may function similarly to the display system 100 of FIG. 1, except that the display system 100*b* may alternatively address the afterimage problem by generating (via the graphics generator 110, FIG. 1) a third set of drive instructions, such that the two-way frame interleaving of the display system 100 (e.g., display surfaces 112/112*a*, FIG. 2A; display surfaces FIGS. 112*d*/*e*, FIG. 3A) becomes a three-way frame interleaving. For example, the display surface 112*l* may be implemented and may function similarly to the display surfaces 112, 112*d*, except that the display surface 112*l* may reflect that each first set of drive instructions corresponding to an Nth frame of the displayed frame sequence (e.g., where N mod 3=1) may cause the drive controller (108, FIG. 1) to draw, in addition to an initial pattern 118 (in regions 114 and 126) and a contrasting pattern 120 (in regions 116 and 128), a third pattern 136 (which may simply be a black frame) to selected regions 138, 140 of the display surface 112*l*.

Figure 5B:
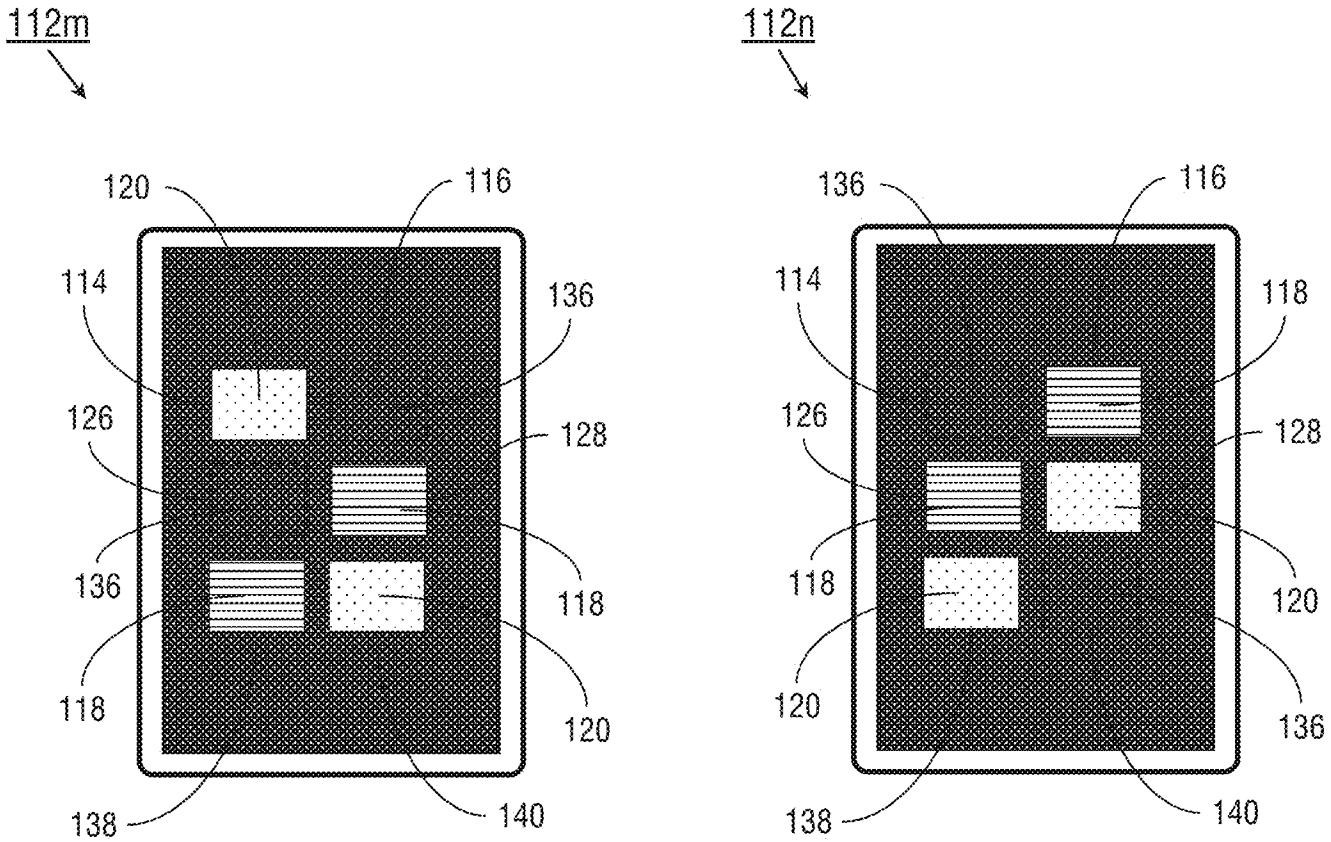

Referring also to FIG. 5B, the display surfaces 112*m,n* may be implemented and may function similarly to the display surface 112*l* of FIG. 5A, except that the display surfaces 112*m,n* may reflect the second and third sets of drive instructions of the displayed frame sequence (e.g., corresponding to a Pth and Rth frame, where P mod 3=2 and R mod 3=0) wherein each selected region (114, 116, 126, 128, 138, 140) of the display surfaces 112*m,n* cycles through the initial pattern 118, the contrasting pattern 120, and the third pattern 136. Sequential application of the patterns shown by the display surfaces 112*l-n* by the display system 100*b* may result in a display surface similar to the display surfaces 112*b* (FIG. 2B), 112*f* (FIG. 3B), and 112*j* (FIG. 3D), wherein all selected regions 114, 116, 126, 128, 138, 140 appear as white or grey regions (e.g., one-third the brightness of a solid white fill, due to the three-frame sequencing). The use of three vertically adjacent regions (e.g., 114/126/138, 116/128/140) may ensure that in the event of a stuck, frozen, or other failure condition, the display system 100*b* always displays a full initial pattern 118 (e.g., a solid red fill). As the display system 100*b* displays a three-frame (as opposed to a two-frame) repeating sequence, any particular pattern drawn by the display system (e.g., the initial pattern 118 drawn to the regions 114 and 126 of the display surface 112*l*) may be associated with opposing voltage polarities in successive instantiations of the corresponding frame, e.g., a first frame corresponding to the display surface 112*l* may be associated with a positive drive voltage while the fourth frame may be associated with a negative drive voltage. The initial and contrasting patterns 118, 120 may similarly include secondary contrasting indicators 122, 124 (FIG. 3A) to enhance visibility of the alert warning should the display system 100 freeze or stick.

As will be appreciated from the above, systems and methods according to embodiments of the inventive concepts disclosed herein may provide passive monitoring of stuck or frozen display conditions for avionics monitors (whether COTS or custom) without the need to incorporate complex and expensive monitoring equipment.

From the above description, it is clear that the inventive concepts disclosed herein are well adapted to carry out the objects and to attain the advantages mentioned herein as well as those inherent in the inventive concepts disclosed herein. While presently preferred embodiments of the inventive concepts disclosed herein have been described for purposes of this disclosure, it will be understood that numerous changes may be made which will readily suggest themselves to those skilled in the art and which are accomplished within the broad scope and coverage of the inventive concepts disclosed and claimed herein.

We claim:

1. A primary flight display (PFD), comprising:

a display surface comprising a two-dimensional array of display elements, the display surface including one or more critical areas including at least one of an airspeed indicator, an altitude indicator, and an attitude indicator;

drive electronics electronically connected to the display elements and configured to draw a sequence of frames on the display surface by executing drive instructions to activate the display elements;

and a graphics controller coupled to the drive electronics, the graphics controller including at least one processor and configured to generate at least one failure indicator, the failure indicator configured to indicate a failure state of the display system, by:

generating a first set of the drive instructions associated with a first frame of the sequence, the first set configured to cause the drive electronics to draw 1) a first pattern within at least one first region of the display surface and 2) a second pattern within at least one second region of the display surface, the second pattern contrasting with the first pattern, the first region and the second region proximate to the one or more critical areas;

generating a second set of the drive instructions associated with a second frame of the sequence, the second frame alternating with the first frame, the second set configured to cause the drive electronics to draw 1) the first pattern within the at least one second region and 2) the second pattern within the at least one first region;

and sending the first set and the second set to the drive electronics for execution.

2. The system PFD of claim 1, wherein the PFD includes at least one active-matrix liquid crystal display (AM-LCD).

3. The PFD of claim 1, wherein the array of display elements includes at least one of a micro light-emitting diode (LED) and an organic LED (OLED).

4. The PFD of claim 1, wherein:

the first set is further configured to cause the drive electronics to draw 1) a third pattern within at least one third region of the display surface, the at least one third region within the at least one first region and the third pattern contrasting with the first pattern, and 2) a fourth pattern within at least one fourth region of the display surface, the at least one fourth region within the at least one second region and the fourth pattern contrasting with the second pattern;

and the second set is further configured to cause the drive electronics to draw 1) the fourth pattern within the at least one third region and 2) the third pattern within the at least one fourth region.

5. The PFD of claim 1, wherein the at least one second region is at least one of horizontally adjacent and vertically adjacent to the at least one first region.

6. The PFD of claim 1, wherein the graphics controller is configured to, every n frames, repeat either the first set or the second set, where n is an integer.

7. The PFD of claim 1, wherein:

the at least one first pattern includes at least one first solid pattern corresponding to a first color;

and the at least one second pattern includes at least one second solid pattern corresponding to a second color complementary to the first color.

8. The PFD of claim 7, wherein the first color and the second color includes at least one of red and cyan.

9. The PFD of claim 1, wherein:

the array of display elements includes a plurality of first display elements within either the at least one first region or the at least one second region, the plurality of first display elements associated with a drive voltage polarity;

and the drive electronics are configured to, after executing the second set, reverse the drive voltage polarity.

10. A primary flight display (PFD), comprising:

a display surface comprising a two-dimensional array of display elements, the display surface including one or more critical areas including at least one of an airspeed indicator, an altitude indicator, and an attitude indicator;

drive electronics electronically connected to the display elements and configured to continuously draw a sequence of frames on the display surface by executing drive instructions to activate the display elements;

and a graphics controller coupled to the drive electronics, the graphics controller including at least one processor and configured to generate at least one failure indicator, the failure indicator configured to indicate a failure state of the display system, by:

generating a first set of the drive instructions associated with every nth frame of the sequence, where n is an integer such that n modulo 3=1, the first set configured to cause the drive electronics to draw:

a first pattern within at least one first region of the display surface;

a second pattern within at least one second region of the display surface, the second pattern contrasting with the first pattern;

and a third pattern within at least one third region of the display surface, the first region, the second region, and the third region proximate to the one or more critical areas;

generating a second set of the drive instructions associated with the sequence, the second set configured to cause the drive electronics to draw:

the first pattern within the at least one third region;

the second pattern within the at least one first region;

and the third pattern within the at least one second region;

generating a third set of the drive instructions associated with the sequence, the third set configured to cause the drive electronics to draw:

the first pattern within the at least one second region;

the second pattern within the at least one third region;

and the third pattern within the at least one first region;

and sending the first set, the second set, and the third set to the drive electronics for execution.

11. The PFD of claim 10, wherein the array of display elements includes at least one of a micro light-emitting diode (LED) and an organic LED (OLED).

12. The PFD of claim 10, wherein:

the second set is associated with every pth frame of the sequence, wherein p is an integer such that p modulo 3=2;

and the third set is associated with every rth frame of the sequence, wherein r is an integer such that r modulo 3=0.

13. The PFD of claim 10, wherein:

the third set is associated with every pth frame of the sequence, wherein p is an integer such that p modulo 3=2;

and the second set is associated with every rth frame of the sequence, wherein r is an integer such that r modulo 3=0.

14. The PFD of claim 10, wherein:

the first set is further configured to cause the drive electronics to draw:

a fourth pattern within at least one fourth region of the display surface, the at least one fourth region within the at least one first region and the fourth pattern contrasting with the first pattern;

and a fifth pattern within at least one fifth region of the display surface, the at least one fifth region within the at least one second region and the fifth pattern contrasting with the second pattern;

the second set is further configured to cause the drive electronics to draw:

the fourth pattern within at least one sixth region of the display surface, the at least one sixth region within the at least one third region;

and the fifth pattern within the at least one fourth region;

and the third set is further configured to cause the drive electronics to draw:

the fourth pattern within the at least one fifth region;

and the fifth pattern within the at least one sixth region.

15. The PFD of claim 10, wherein one or more of the at least one second region and the at least one third region is at least one of horizontally adjacent and vertically adjacent to the at least one first region.

16. The PFD of claim 10, wherein:

the at least one first pattern includes at least one first solid pattern corresponding to a first color;

the at least one second pattern includes at least one second solid pattern corresponding to a second color complementary to the first color;

and the at least one third pattern includes at least one solid black pattern.

* * * * *